US006814005B1

(12) United States Patent
Vestre

(10) Patent No.: US 6,814,005 B1
(45) Date of Patent: Nov. 9, 2004

(54) DETONATOR

(75) Inventor: Jan Hans Vestre, Reistad (NO)

(73) Assignee: Dyno Nobel Sweden AB, Nora (SE)

( * ) Notice: Subject to any disclaimer, the term of this patent is extended or adjusted under 35 U.S.C. 154(b) by 0 days.

(21) Appl. No.: 10/070,366

(22) PCT Filed: Sep. 7, 2000

(86) PCT No.: PCT/SE00/01733

§ 371 (c)(1),
(2), (4) Date: May 13, 2002

(87) PCT Pub. No.: WO01/18484

PCT Pub. Date: Mar. 15, 2001

(30) Foreign Application Priority Data

Sep. 7, 1999 (SE) ..... 9903158

(51) Int. Cl.[7] ..... F42C 11/00
(52) U.S. Cl. ..... 102/202.5; 102/275.11
(58) Field of Search ..... 102/202.2, 202.5, 102/275.6, 275.11

(56) References Cited

U.S. PATENT DOCUMENTS 3,641,938 A * 2/1972 Gawlick et al. ..... 102/207
3,713,391 A * 1/1973 Stout et al. ..... 102/207
4,664,033 A 5/1987 Burkdoll et al.
5,252,796 A 10/1993 Hedger
5,526,749 A 6/1996 Teetzel

FOREIGN PATENT DOCUMENTS

WO WO 89/01601 A1 2/1989
WO WO 96/04522 A1 2/1996

* cited by examiner

*Primary Examiner*—Jack Keith
*Assistant Examiner*—Gabriel S. Sukman
(74) *Attorney, Agent, or Firm*—Burns, Doane, Swecker & Mathis, L.L.P.

(57) ABSTRACT

An electronic detonator which comprises an ignition charge, a battery unit for emitting ignitor current for initiating the ignition charge, and an electronic circuit for controlling said emission of igniter current. The battery unit is movable in the detonator between a resting position and an activated position, in which the battery unit is connected to emit said igniter current. Battery activating means are provided, in response to external activation, for pyrotechnically causing the battery unit to move from the resting position to the activated position.

24 Claims, 3 Drawing Sheets

DETONATOR

TECHNICAL FIELD

The present invention relates to an electronic detonator adapted for civil use of the type which comprises an ignition charge, a battery unit for emitting igniter current for initiating the ignition charge and an electronic circuit for controlling said emission of igniter current.

TECHNICAL AREA

Electronic detonators which have been proposed up to the present are generally adapted to use, as an igniter current emitting means, a current storing means, such as a capacitor, which before initiating the ignition charge is charged by means of current that is supplied via the control lines (often a two-wire bus) to which the detonator is connected and by which detonator set-up signals and detonator firing signals are communicated. If the detonator has a built-in battery, for instance, to drive the electronics of the detonator, it has been deemed to be most essential that the capacity or energy content of the battery does not allow emission of current which could initiate the ignition charge even if, for unknown reasons, current paths required therefor would be provided.

A "nonelectrical" detonator has been suggested (see WO 96/04522) which is activated via a so-called ignition or shock tube and which comprises a battery for emitting igniter current for initiating an ignition charge, the battery either being active and connected by means of a switch which is acted upon by the pressure generated by the burning ignition tube in the detonator, or alternatively being connected but will be activated, for instance thermally, by action from the burning ignition tube.

However, those skilled in the art would realise that using a switch or activating a battery as stated above generally means uncertainty in the present context and can easily result in an undesirable current supply with the ensuing uncontrollable detonation.

SUMMARY OF THE INVENTION

The object of the present invention is to provide an electronic detonator which is provided with a battery, whereby the risks of uncontrollable initiation of the ignition charge of the detonator as a result of non-intended battery current supply are, in practice, completely eliminated.

The above-mentioned object is achieved by means of an electronic detonator which exhibits features according to the invention which are evident from the appended claims.

The invention is thus based on the understanding that primarily battery connection must not take place by switch-controlled connection or externally provided activation of a battery, but by an active battery unit (consisting of one or more active cells), in the following referred to as "battery", being caused to move inside the detonator to a position where igniter current can be emitted. Suitably, it is a matter of the battery being caused to move between a resting position, in which igniter current cannot be taken out of the battery, to an activated position, in which the battery is prepared to emit igniter current. The motion of the battery is conditioned by the action of mechanical forces exerted on the battery, which has to be of a predetermined magnitude and has a predetermined direction in order to overcome a strong inertia of motion of the battery. These parameters of action may be chosen so that only desirable, expected action of forces causes motion of the battery while overcoming said inertia of motion of the battery, while other sorts of uncontrolled action owing to shock, acceleration and similar rough treatment, as well as action caused by static electricity and electric and magnetic fields do not cause any motion of the battery and, consequently, any risk of undesirable battery connection.

Suitably, the detonator according to the invention comprises battery activating means which are adapted to provide, in response to external activation, such as by means of an ignition tube or electric control signals, the required application of forces on the battery. Said activating means preferably operate pyrotechnically. Advantageously, use is made of a drive or propellant charge which is arranged in the detonator and is releasable in a controlled manner and which in connection with combustion generates such a pressure that the desired application of forces is obtained. The drive charge can be released electrically or by means of an ignition tube. It is also possible to work without a drive charge, in which case the pressure of the gases which are generated in connection with the combustion of the ignition tube charge is used to generate the required driving pressure inside the detonator.

When using a drive charge, it is advantageously arranged in a drive chamber, to which an actuation part of the battery is exposed to be acted upon so as to cause movement by means of a driving pressure which is generated in the drive chamber by the drive charge. When an ignition tube is used, it is suitable to arrange a non-return valve at the connection of the ignition tube to the drive chamber in order to prevent the driving pressure generated in the drive chamber from being discharged via the ignition tube.

The battery is advantageously given the shape of a plunger or piston which is arranged in a corresponding bore in the detonator. In this connection, it is preferred for the bore to be arranged in a tubular element which is dimensionally stable and resistant to mechanical action and which has a longitudinal extension at least corresponding to the longitudinal extension of the battery and the distance of motion of the battery between a resting position and an activated position as well as a preferred free space in front of the front end of the battery (seen in the direction of motion), when the battery has moved to the activated position.

Since detonators conventionally are elongated and have an ignition charge in one end, it is suitable that the axial direction of said tubular element is parallel to and preferably coincides with the longitudinal axial direction of the detonator.

When using a drive chamber, it is suitably aligned with the bore in a tubular element according to the above, preferably constituting an extension thereof.

Constructively, the tubular element and the drive chamber are advantageously formed as a pressure vessel in order to be able to resist a predetermined pressure which in any case exceeds the driving pressure required to cause the battery to move from a resting position to an activated position. At the same time, a very stable and resistant construction is obtained, as is appreciated, the construction having a great capacity of resisting rough treatment, especially in the transverse direction, which otherwise could possibly involve a risk of uncontrolled change as regards motion of the battery.

The motion of the battery from a resting position to the activated position preferably occurs towards the ignition charge. Thus, improved safety is obtained in connection with uncontrolled axial action due to acceleration (transverses action due to acceleration constitutes, as those skilled in the art realise, no risk). Action due to acceleration which should be able to cause "forward" motion of the battery towards the ignition charge must in principle mean an impact in the longitudinal direction of the detonator on the end of the ignition charge of the detonator or, alternatively, "backward" jerks in the opposite end of the detonator. In the first case, the ignition charge will detonate due to the impact itself a long time before the battery starts moving towards the activated position. In other words, here it is not a matter of any additional risks. In the second case, with "backward" jerks, it is in practice almost impossible to bring about such a powerful longitudinal acceleration of the detonator that the battery will be caused to move forwards to the activated position. If an ignition tube or the like is connected to the associated end of the detonator, it may also be advantageous to make the connection to the detonator in such a manner that in connection with jerks, for instance, in the ignition tube, the ignition tube or its fixing in the detonator breaks well before the detonator has been subjected to hazardous acceleration.

As mentioned above, it is essential that the battery should not move easily, but exhibit the required inertia of motion. According to the invention, preferably this inertia is dependent on friction, that is the battery is movable from its resting position to its activated position against the action of a frictional force, in a wide sense. Preferably, the frictional force is adapted to increase from a significant starting value, after the battery has moved, during acceleration, an initial distance from the resting position. Stopping the battery in its activated position advantageously takes place by the frictional force there being adapted to be further increased, possibly in combination with motion-stopping deformation and/or penetration work in connection with the battery being contacted to allow delivery of current.

The frictional force mentioned above can, when the battery moves as a piston in a bore, be ensured by means of adaptation of the diameter and/or special friction-generating elements, such as projections, rib elements or the like, on the bore wall and/or the bore facing surface or circumferential surface of the battery.

In order to allow current supply from the battery, its two poles have to be contacted with suitable current conductors. According to the invention, the two poles of the battery are advantageously not contacted until the battery is approaching or has reached its activated position. In their non-contacted position, the poles of the battery are preferably insulated or encapsulated, advantageously by the entire battery in its resting position being encapsulated in an insulated fashion.

In a preferred embodiment, the battery has at least one contact terminal which in a non-activated position of the battery is coated with insulation and which in the activated position of the battery is adapted to be penetrated by a co-operating contacting means in the detonator. It is especially preferred that the battery on its front end side should be provided with a contact terminal which is coated with insulation and which is adapted to be contacted, when the battery is in its activated position, by a contact pin which penetrates the insulation and is arranged in the bore for the battery.

Preferably, the contacting of the two poles of the battery takes place at essentially separated locations, so that the number of conditions required for the contacting is increased.

In the preferred embodiment, thus a second contact terminal coated with insulation is arranged on the bore side of the battery, a co-operating contacting means being arranged protruding in the bore, so that, when the battery is in the activated position, the contacting means penetrates the insulation of the contact terminal and is in contact with the contact terminal.

With a view to further increasing the safety as regards uncontrolled connection of the battery, an independent contact arrangement or switch arrangement can be arranged in a line circuit for emitting igniter current from the battery, the contact arrangement being open in a state of rest and closed in an activated state, the contact arrangement being adapted to be moved from the state of rest to the activated state in response to the external activation. Said arrangement is advantageously adapted to be affected by the driving pressure which is generated to act on the battery.

A doubled battery connecting system of the above type is especially advantageous when the direction of motion of the battery from the resting position to the activated position and a direction of motion of the contact arrangement when passing from the open to the closed state are essentially separated, preferably at least essentially opposite or essentially orthogonal. As will be appreciated, this means that in all probability uncontrolled action due to acceleration can in any case only provide one of the two connecting functions required for current supply from the battery.

In the following, the invention will be described in more detail by way of non-limiting examples with reference to the accompanying drawings.

DESCRIPTION OF EMBODIMENTS

Figure 1:
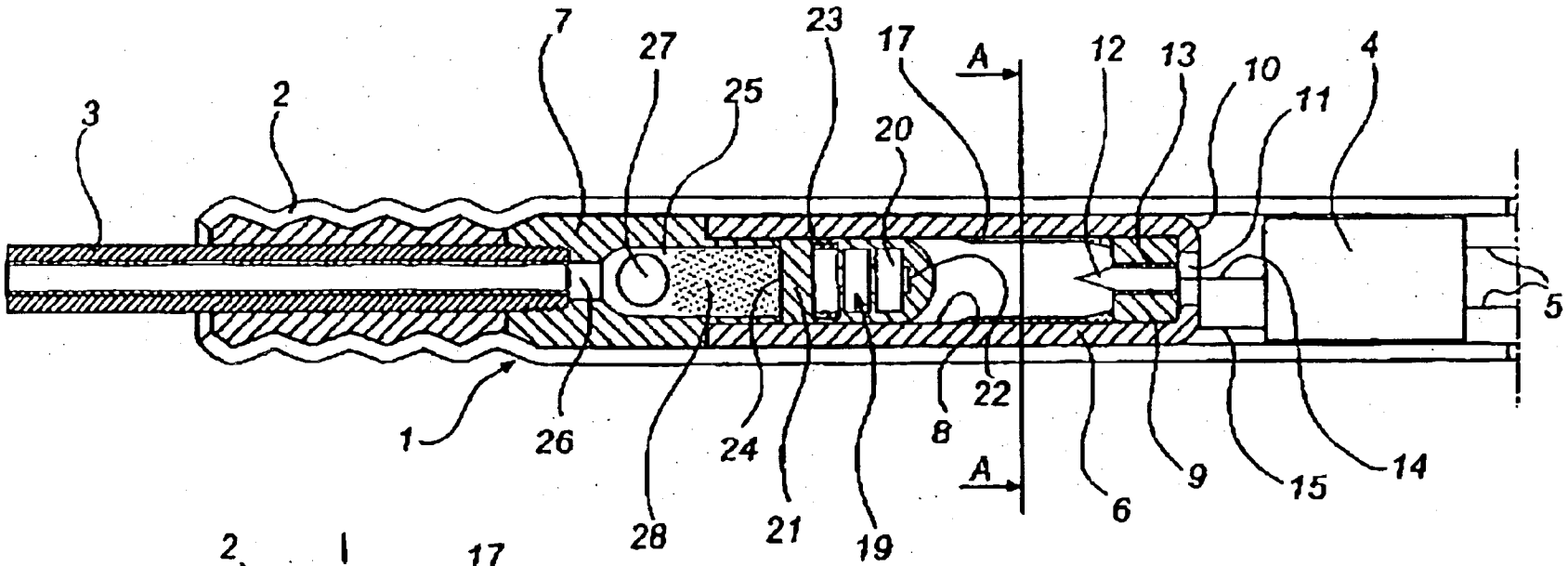
FIG. 1 is a schematic longitudinal section of a part of an electronic battery with an ignition tube connected at the rear end thereof, the detonator comprising a battery function in a resting position in accordance with an embodiment of the present invention.
Figure 2:
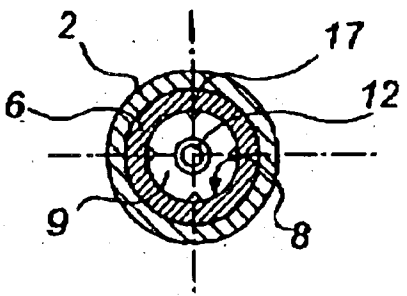
FIG. 2 is a schematic cross-section along the line A—A in FIG. 1.

FIGS. 1 and 2 schematically illustrate an embodiment of an electronic detonator in accordance with a first embodiment of the present invention. The basic design of the detonator, which is generally designated 1, is completely conventional since it has an elongated cylindrical shape with an external sleeve 2 of aluminium, at the rear end of which a pyrotechnic ignition tube 3 (such as a NONEL® tube) is connected in a conventional manner. Inside the sleeve, an ordinary electronic circuit 4 is arranged. This circuit can in any suitable way control the detonation delay of the detonator, which comprises control of the final closing of the current path in order to bring about detonation. An ignition charge is also conventionally arranged in the front end of the detonator, which for the sake of clarity is not shown in FIG. 1. For detonation of the ignition charge the necessary current signals are fed from the circuit 4 to the ignition charge via wires 5.

In connection with the rear connection of the ignition tube 3, a controllable current supply device is arranged inside the sleeve 2. The current supply device comprises a cylindrical casing element configured as a pressure vessel which is designed in a very stable manner as regards shape and resistance and consists of two axially joined steel tubular elements 6 and 7. The front tubular element 6 has a circular-cylindrical bore 8 and is closed in front by means of a steel plug 9 which is fixed to the end of the bore. The front end of the tubular element 6 encompasses and further secures the plug 9, as shown at 10, a central opening 11 giving access to the plug 9. A pointed contact pin 12 of steel is fixed centrally in the plug. The pin 12 is electrically insulated from the plug 9 by means of enclosing insulation 13 and electrically connected to the circuit 4 via a first current supply wire 14. A second current supply wire 15 to the circuit 4 issues from the tubular element 6. The pointed part of the pin 12 points backwards and extends axially into the bore 8.

In the front part of the bore 8, four longitudinal ribs 17 are uniformly distributed on the bore wall. The ribs extend from the plug 9 and backwards in the bore 8 over about half the length of the bore. The ribs are essentially triangular in cross-section and are ramp-shaped at their rear end and successively increasing at their front part connecting with the plug 9. The function of the ribs 17 will be described below.

In the bore 8 a battery 19 is arranged in the form of a completely encapsulated battery unit consisting of three battery cells 20 axially connected in series. The encapsulation 21 is made of electrically insulating material, such as plastic, and gives the battery essentially the shape of an ammunition bullet, the diameter of which is adapted to the diameter of the bore 8, so that the fit almost is to be considered as a force fit, whereby the battery 19 is movable in the bore 8 only with great inertia, that is against the action of an essential frictional resistance. The front end of the battery is rounded and includes an axial embedded first battery pole contact terminal 22. A similarly insulated embedded second battery pole contact terminal 23 consists of a copper ring which encompasses the rearmost battery cell and is arranged somewhat below the circumferential or bore facing surface of the battery. The rear end face 24 of the battery extends transversely to the axial direction of the battery and the bore and constitutes a driving surface, that is a surface which is designed for applying driving force to the battery.

The rear tubular element 7 defines a similar circular-cylindrical drive chamber 25 which constitutes an extension of the bore 8, although with a somewhat reduced diameter. The ignition tube 3 is fixed to the rear end of the tubular element 7 in an axial duct 26 which leads into the drive chamber and whose drive chamber end constitutes a seat for a ball of a non-return valve which is arranged in the drive chamber. A drive charge 28 is arranged in the drive chamber and can be ignited by means of the ignition tube 3.

In FIG. 1, the detonator is illustrated in a basic state, that is a non-discharged state, the battery 19 being in a resting position at the rearmost end of the bore 8 with its rear driving surface 24 in direct connection with the drive chamber 25. When the detonator is to be made to detonate, the burning ignition tube 3 will ignite the drive charge 28 in the drive chamber 25, exhaust gases being quickly developed, which increases the pressure in the drive chamber. The considerably increased pressure moves the ball 27 of the non-return valve into sealing abutment against the duct 26 and drives the battery forwards to an activated position. The state thus obtained is illustrated in FIG. 3.

Initially, the battery is accelerated by the driving pressure and against the action of the resistance as a result of the friction between the bore well and the circumferential surface of the battery up to a high speed which typically may be in the order 100 m/s or more. After having moved about half its distance of motion, the battery contacts the ribs 17, the frictional resistance increasing significantly by the ribs penetrating into the plastic encapsulation 21. When the battery approaches its end position of motion, it is stopped as a consequence of further resistance caused by the enlarged front ends of the ribs 17 and the contacting process. This process consists of, on the one hand, the pin 12 penetrating the front end encapsulation of the battery and contacting the pole terminal 22 of the battery, and, on the other hand, the rear end parts of the ribs 17 penetrating the side encapsulation of the battery into contact with the copper ring 23. In other words, the battery is in this position connected to the electronic circuit 4 via the wire 14, which is in contact with the battery pole 22 via the pin 12, and via the wire 15 which is in contact with the battery pole 23 via the wall of the tubular element 6 and the steel ribs 17 which are electrically connected thereto.

Figure 3:
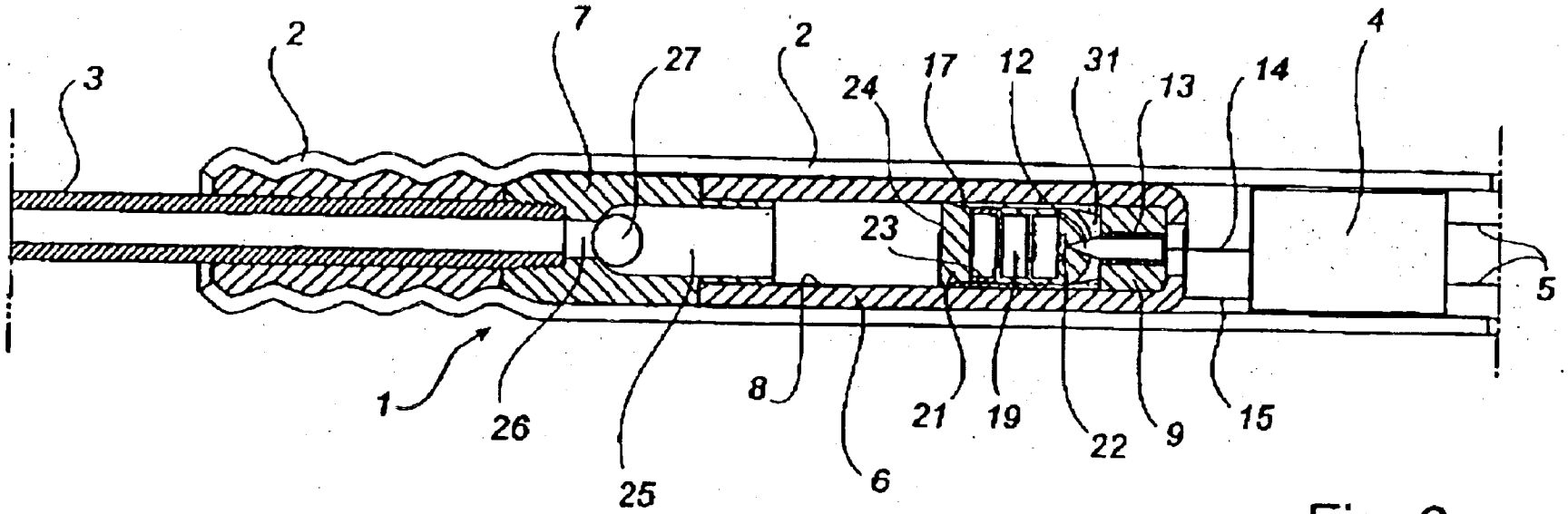
FIG. 3 is a schematic longitudinal section as in FIG. 1, the battery being moved to an activated position.

It will be noted that in the activated position shown in FIG. 3 the front end of the battery is not in contact with the plug 9, but in front of the battery remains a small free bore space 31. This space allows receiving of the compressed air which forms in front of the battery when this is driven from its resting position to its activated position. This compression promotes stopping of the battery.

Figure 4:
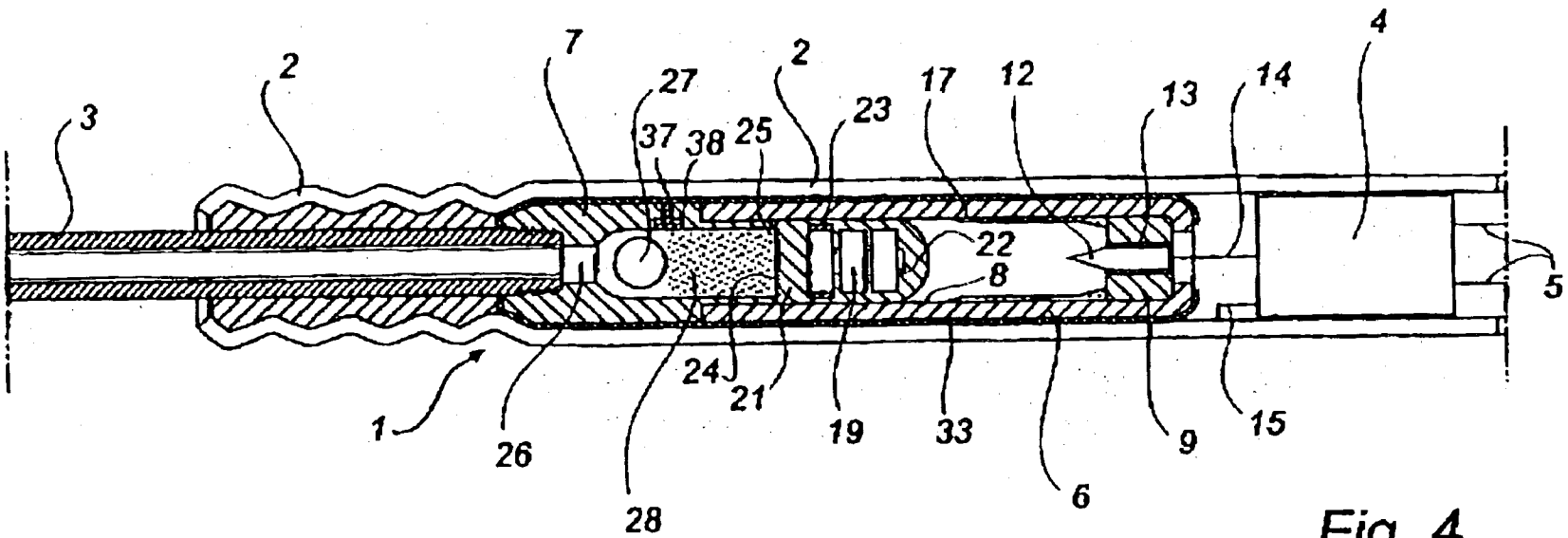
FIG. 4 is a schematic longitudinal section of the same type as in FIG. 1 regarding another embodiment of the invention.

FIG. 4 illustrates a modification of the detonator according to FIGS. 1–3, in which a supplementary safety function has been arranged in the form of a separate switch arrangement which is detached from the motion of the battery. This is arranged in the wall of the drive chamber and is affected by the driving pressure which is generated in the drive chamber when initiating the detonator. In the following, only the modifications which have been made in relation to the embodiment according to FIGS. 1–3 will be described in more detail.

The combination of the tubular elements 6 and 7 is in this case electrically insulated from the external sleeve 2 by means of an insulation 33. One current supply wire 15 of the electronic circuit 4 is here connected to the electrically conductive external sleeve 2 instead of to the tubular element 6 as in FIG. 1. In order to achieve controlled closing of a current path between the external sleeve 2 and the tubular elements 6, 7, a contact element 37 is movably arranged in the wall of the drive chamber, so that closing takes place when the driving pressure in the drive chamber drives the contact element radially outwards to penetrate the insulation 33 and to electric contact with the external sleeve 2. The contact element 37 is made of conductive steel material and is in electrically conductive, although movable, contact with the wall of the drive chamber in the recess 38 which is formed therein and adapted to the contact element. The through recess 38 has an outer part with a reduced diameter, in which a pointed part of the contact element is fitted, and an inner cylindrical part in which a piston part of the contact element is insertable with a fit. The fit of the contact element 37 in the recess 38 is such that a considerable driving pressure is required in the drive chamber for overcoming a resistance of motion of the contact element. Thus, it is ensured that a connection-generating motion of the contact element 37 cannot take place as a result of undesirable or uncontrolled action applied to the detonator as discussed above regarding the motion of the battery.

It will be appreciated that the fact that the battery 19 and the contact element 37 have to move in directions which are perpendicular to one another essentially decreases the risk of uncontrolled closing of the current paths between the battery and the electric circuit.

The following is given as very general examples of parameters concerning a detonator which includes the present invention.

| | |
|---|---|
| diameter of the external sleeve: | about 6.5 mm |
| diameter of the bore: | about 3 mm |
| wall thickness of the bore tubular element: | about 1 mm |
| frictional force which the battery has to overcome: | several tens of kp |
| weight of the battery: | about 0.5 g |
| distance of motion of the battery: | about 10 mm |
| time for the motion of the battery from the resting position to the activated position: | about 0.1 ms |
| driving force on the driving end face of the battery: | about 1500 kp |
| total weight of the detonator: | about 15 g |

Given these conditions, it is possible to estimate that the battery can be exposed to an axial acceleration in the order of tens of thousands G without the battery moving to the activated position. This means, as will be appreciated, an extraordinarily high degree of safety.

If an additional contact function, for instance in accordance with that illustrated in FIG. 4, is used, the safety as regards uncontrolled initiation will be improved, so that the requirements as to resistance to motion and capacity of resisting axial acceleration of the battery can be decreased. Thus, it is possible to reduce the amount of drive charge and work at lower pressure in the drive chamber, which, in its turn, reduces the requirements as to the pressure-vessel-like tubular element construction. Wall thicknesses that are thus decreased allow larger diameters of the battery, which facilitates the choice of type of battery.

What is claimed is:

1. An electronic detonator comprising an ignition charge, a battery unit for emitting igniter current for initiating the ignition charge, an electronic circuit for controlling the emission of igniter current, and a flexible pyrotechnic shock tube, the battery unit being per se operative to emit igniter current and being movable in the detonator between a resting position, where the battery unit is electrically separated from the electronic circuit, and an activated position, where the battery unit is electrically connected to the electronic current, and battery moving means being provided, in response to external activation by the flexible pyrotechnic shock tube, for pyrotechnically causing the battery unit to move from the resting position to the activated position whereafter ignition current for initiating the ignition charge is emitted after a predetermined time delay controlled by said electronic circuit, wherein the battery unit has the shape of a plunger or piston and is arranged in a corresponding bore in the detonator, the bore being arranged in a tubular element which has a longitudinal extension essentially corresponding to a longitudinal extension of the detonator, the battery unit being movable in the bore from its resting position to its activated position against the action of a frictional force.

2. A detonator as claimed in claim 1, wherein the pyrotechnic shock tube is connected to the detonator.

3. A detonator as claimed in claim 1, wherein the battery activating means comprises a drive charge for the battery unit, the drive charge being arranged in the detonator.

4. A detonator as claimed in claim 3, wherein a pyrotechnic shock tube connection is provided at the drive charge.

5. A detonator as claimed in claim 3, wherein the drive charge is arranged in a drive chamber, to which an actuation part of the battery unit is exposed to be acted upon so as to cause movement by means of a driving pressure which is generated in the drive chamber by the drive charge.

6. A detonator as claimed in claim 5, wherein the drive chamber is arranged in a tubular element extension aligned with the bore.

7. A detonator as claimed in claim 5, wherein the tubular element and the drive chamber have walls formed as a pressure vessel in order to resist a predetermined driving pressure.

8. A detonator as claimed in claim 1, wherein the bore in the detonator is formed in such a manner that, when the battery unit is in its activated position, a free space remains in front of the battery unit, in which gas pushed forward by the battery unit can be compressed.

9. A detonator as claimed in claim 1, further comprising a contact arrangement in a line circuit for emitting igniter current from the battery unit, the contact arrangement being open in a state of rest and closed in an activated state, the contact arrangement being adapted to be moved from the state of rest to the activated state in response to the pyrotechnic activation.

10. A detonator as claimed in claim 9, wherein a direction of motion of the battery unit from the resting position to the activated position and a direction of motion of the contact arrangement when passing from an open to a closed state are substantially separated, at least essentially opposite or essentially orthogonal.

11. A detonator as claimed in claim 1, wherein the motion of the battery unit from the resting position to the activated position occurs toward the ignition charge, the distance of motion being at least about 1 cm.

12. A detonator as claimed in claim 1, wherein the battery unit, in its resting position, is completely encapsulated in an electrically insulated fashion.

13. An electronic detonator comprising an ignition charge, a battery unit for emitting igniter current for initiating the ignition charge, and an electronic circuit for controlling the emission of igniter current, the battery unit being movable in the detonator between a resting position and an activated position, in which the battery unit is connected for emitting the igniter current in a controlled way, and battery activating means being provided, in response to external activation, for pyrotechnically causing the battery unit to move from the resting position to the activated position, wherein the battery unit has the shape of a plunger or piston and is arranged in a corresponding bore in the detonator, the bore being arranged in a tubular element which is dimensionally stable and resistant to mechanical action and which has a longitudinal extension essentially corresponding to a longitudinal extension of the detonator, the battery unit being movable in the bore from its resting position to its activated position against the action of a frictional force, wherein the battery activating means comprises a drive charge for the battery unit, the drive charge being arranged in the detonator;

wherein the drive charge is arranged in a drive chamber, to which an actuation part of the battery unit is exposed to be acted upon so as to cause movement by means of a driving pressure which is generated in the drive chamber by the drive charge;

wherein a non-return valve is arranged at an ignition tube connection to the drive chamber in order to prevent driving pressure generated in the drive chamber from being discharged via the ignition tube connection.

14. An electronic detonator comprising an ignition charge, a battery unit for emitting igniter current for initiating the ignition charge, and an electronic circuit for controlling the emission of igniter current, the battery unit being movable in the detonator between a resting position and an activated position, in which the battery unit is connected for emitting the igniter current in a controlled way, and battery activating means being provided, in response to external activation, for pyrotechnically causing the battery unit to move from the resting position to the activated position, wherein the battery unit has the shape of a plunger or piston and is arranged in a corresponding bore in the detonator, the bore being arranged in a tubular element which is dimensionally stable and resistant to mechanical action and which has a longitudinal extension essentially corresponding to a longitudinal extension of the detonator, the battery unit being movable in the bore from its resting position to its activated position against the action of a frictional force, wherein the frictional force is adapted to increase after the battery unit has moved an initial distance from the resting position.

15. A detonator as claimed in claim 14, wherein the frictional force is adapted to successively increase to stop the motion of the battery unit at the end of the motion process.

16. An electronic detonator comprising an ignition charge, a battery unit for emitting igniter current for initiating the ignition charge, and an electronic circuit for controlling the emission of igniter current, the battery unit being movable in the detonator between a resting position and an activated position, in which the battery unit is connected for emitting the igniter current in a controlled way, and battery activating means being provided, in response to external activation, for pyrotechnically causing the battery unit to move from the resting position to the activated position, wherein the battery unit has the shape of a plunger or piston and is arranged in a corresponding bore in the detonator, the bore being arranged in a tubular element which is dimensionally stable and resistant to mechanical action and which has a longitudinal extension essentially corresponding to a longitudinal extension of the detonator, the battery unit being movable in the bore from its resting position to its activated position against the action of a frictional force, comprising friction generating elements on a bore wall and/or a bore facing surface of the battery unit.

17. A detonator as claimed in claim 16, wherein the friction generating elements comprise projections on the bore wall for engaging with the bore facing surface of the battery unit.

18. A detonator as claimed in claim 17, wherein the projections comprise rib elements which extend parallel to a direction of motion of the battery unit.

19. A detonator as claimed in claim 18, wherein the projections from the bore wall have an increased height at a battery unit activating end of the bore.

20. A detonator as claimed in claim 16, wherein the motion-counteracting frictional force is adapted to prevent motion of the battery unit to the activated position in connection with action due to acceleration in a direction of motion, at least up to a predetermined level.

21. An electronic detonator comprising an ignition charge, a battery unit for emitting igniter current for initiating the ignition charge, and an electronic circuit for controlling the emission of igniter current, the battery unit being movable in the detonator between a resting position and an activated position, in which the battery unit is connected for emitting the igniter current in a controlled way, and battery activating means being provided, in response to external activation, for pyrotechnically causing the battery unit to move from the resting position to the activated position, wherein the battery unit has the shape of a plunger or piston and is arranged in a corresponding bore in the detonator, the bore being arranged in a tubular element which is dimensionally stable and resistant to mechanical action and which has a longitudinal extension essentially corresponding to a longitudinal extension of the detonator, the battery unit being movable in the bore from its resting position to its activated position against the action of a frictional force, wherein the battery unit has at least one contact terminal which in a non-activated position of the battery unit is coated with insulation and which in the activated position of the battery unit is adapted to be penetrated by a cooperating contacting means in the detonator.

22. A detonator as claimed in claim 21, wherein a contact terminal which is coated with insulation is arranged on a bore side of the battery unit and wherein a co-operating contacting means is arranged protruding in the bore, so that when the battery unit is in the activated position, the contacting means penetrates the insulation of the contact terminal and is in contact with the contact terminal.

23. A detonator as claimed in claim 21, wherein the contacting means is included in friction generating elements on a bore wall.

24. A detonator as claimed in claim 21, wherein the battery unit has a front end side provided with a contact terminal which is coated with insulation and which is adapted to be contacted, when the battery unit is in its activated position, by a contact part which penetrates the insulation and is arranged in the bore.

* * * * *